United States Patent [19]

Strong et al.

[11] Patent Number: 4,967,654

[45] Date of Patent: Nov. 6, 1990

[54] PRINT HEAD SETTING APPARATUS

[75] Inventors: Michael D. Strong, Enola; Charles E. Zimmermann, Birdsboro, both of Pa.

[73] Assignee: AMP Incorporated, Harrisburg, Pa.

[21] Appl. No.: 377,663

[22] Filed: Jul. 10, 1989

[51] Int. Cl.[5] ..... B41J 7/00

[52] U.S. Cl. ..... 101/18; 101/110; 101/486

[58] Field of Search ..... 101/18, 110, 99, 95, 101/42, 43, 486

[56] References Cited

U.S. PATENT DOCUMENTS

| | | | |
|---|---|---|---|
| 3,771,442 | 11/1973 | Ditman | 101/99 |
| 3,875,859 | 4/1975 | Busch | 101/99 |
| 4,050,375 | 9/1977 | Orlens | 101/110 |
| 4,566,164 | 1/1986 | Brown et al. | 29/33 M |
| 4,593,452 | 6/1986 | Keahey et al. | 29/564.6 |
| 4,647,323 | 3/1987 | Darstein et al. | 156/50 |
| 4,653,160 | 3/1987 | Thorkildsen et al. | 29/33 M |
| 4,719,853 | 1/1988 | Bowers | 101/110 |

FOREIGN PATENT DOCUMENTS

| | | | |
|---|---|---|---|
| 227053 | 10/1986 | Japan | 101/110 |
| 489553 | 1/1976 | U.S.S.R. | 101/18 |

OTHER PUBLICATIONS

Mts Vektronics Corporation Catalog for Wire Vektor 2000A System.

Artos WM-100 Dial Model Automatic Hot Stamp Wire Marking Device Sheet.

Brady Bradymark & Porta-Mark Hot Stamp Markers Bulletin, MS-821.

Acker Gould Model MF-4W Catalog, Model AC-3, Catalog and 40-Digit Wheeled Head Drawing.

*Primary Examiner*—Clifford D. Crowder

*Attorney, Agent, or Firm*—James M. Trygg

[57] ABSTRACT

A method and apparatus for setting a plurality of print wheels, in an automated cable making machine for imprinting a desired set of characters onto a connector housing. The method includes a unique way of homing each of the print wheels to a known position prior to setting the print wheels to their desired print positions. This is a done by rotating each print wheel until a rod, which is constrained to move only along its longitudinal axis, can be inserted into an opening in the print wheel. This prevents further rotation of the print wheel thereby indicating that the wheel is in its home position.

10 Claims, 5 Drawing Sheets

PRINT HEAD SETTING APPARATUS

This invention relates to hot stamping apparatus for marking connector housings in an automated electrical harness making machine, and more particularly relates to the positioning of the print wheels of such apparatus to a desired setting.

BACKGROUND OF THE INVENTION

Automated electrical cable making machines typically payout wire from a so-called, endless source, measure and cut the wire to form a wire segment, optionally attach appropriate terminals to one or both ends of the wire segment, and optionally insert one or both ends into a connector housing. Such automated machines are designed to work with either ribbon cable or discrete wires. The need for more sophisticated electrical cables has resulted in correspondingly more complex automated machinery for making these cables. For example, U.S. Pat. Nos. 4,566,164 which issued Jan. 28, 1986 to Brown et al.; 4,653,160 which issued Mar. 31, 1987 to Thorkildsen et al.; 4,647,323 which issued Mar. 3, 1987 to Darstein et al.; and 4,593,452 which issued June 10, 1986 to Keakey et al., all disclose automated cable making machines of this type. As more complex cable assemblies are made which may have several different connectors attached thereto, it becomes desirable to uniquely identify these different connectors to facilitate subsequent assembly of the cable to its host apparatus and for identifying different cable assemblies and branch circuits.

What is needed is an automated system for identifying such connectors during the manufacture of the cable assembly. A commercially available hot stamp marking machine may be utilized, such as the machine model MF-4W manufactured by Ackerman Gould Co. Inc. of 125 Wilbur Place, Bohemia, N.Y. 11716-2400. However, this machine has no capability for automated indexing of the print wheels. The present invention addressed this problem by providing a unique method of automatically setting the print wheels to a desired set of print characters.

SUMMARY OF THE INVENTION

The present invention is a method and apparatus for automatically setting a plurality of print wheels of a print head to a desired value for marking a connector housing. The print wheels are arranged for individual rotation about a common axis, each of which has a home position relative to the apparatus. Means is provided for selecting individual ones of the print wheels and including means for rotating such selected wheels. Included is means for positively stopping rotation of each print wheel when the wheel reaches its home position only when the means is enabled. The method includes the following steps: (a) selecting the first print wheel; (b) enabling the means for positively stopping rotation; (c) if all print wheels are in their home positions, go to step (g); (d) activating the means for rotating to rotate the selected print wheel a specific amount; (e) if the selected print wheel actually rotated as desired then repeat steps (b) through (e); (f) selecting the next print wheel and repeating steps (b) through (f); (g) disabling the means for positively stopping rotation; (h) selecting one of the print wheels; (i) rotating the selected wheel to the desired position; (j) if all the print wheels are not in their desired positions then repeating steps (h), (i), and (j); and (k) locking the print wheels in their respective desired positions.

DESCRIPTION OF THE DRAWINGS

FIG. 6 is a schematic representation of the functional elements of the print wheel positioning system of the present invention.

DESCRIPTION OF THE PREFERRED EMBODIMENT

Figure 1:
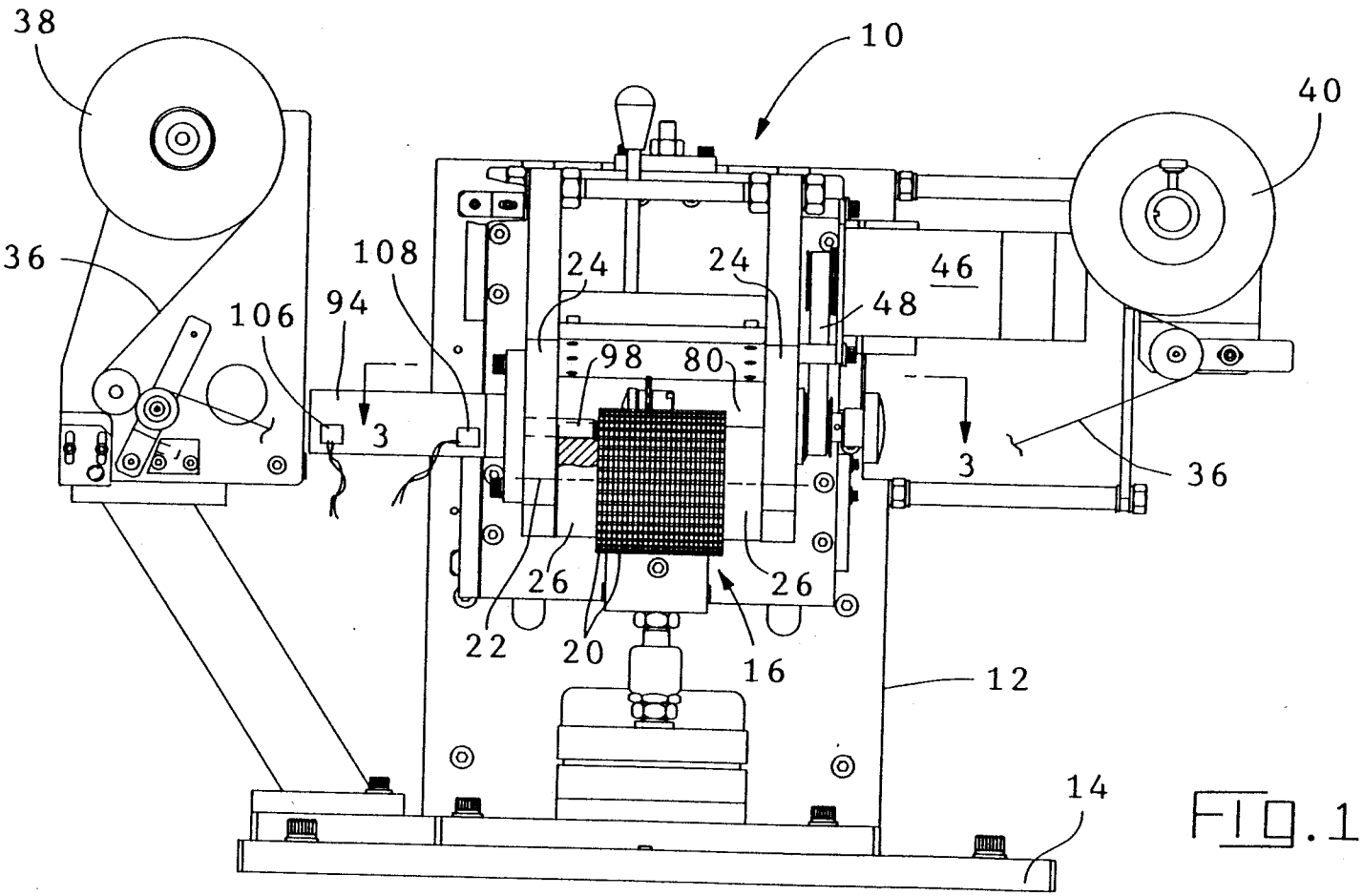
FIG. 1 is a front view of a marking apparatus embodying the teachings of the present invention.
Figure 2:
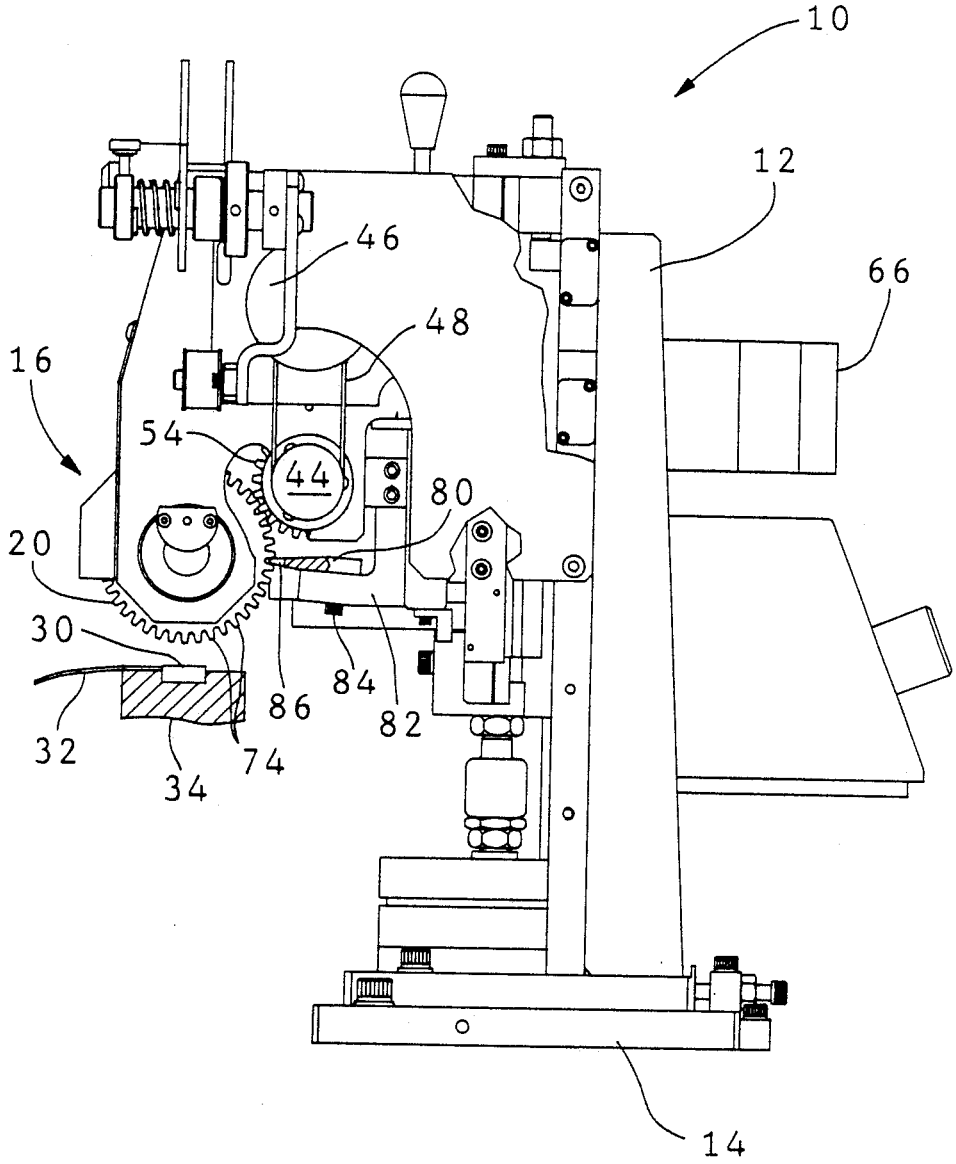
FIG. 2 is a side view of the apparatus shown in FIG. 1.

There is shown in FIGS. 1 and 2 a hot stamping apparatus 10 having a frame 12, a base 14, and a print wheel head 16, arranged for reciprocating motion toward and away from said base 14. The print head is similar to the print head of the aforementioned Ackerman Gould hot stamp machine, model MF-4W in that a plurality of print wheels 20 are journaled for rotation about a common axis 22 within a print head frame 24. A pair of cylindrically shaped spacers 26 are arranged on either side of the plurality of print wheels 20 for positioning the print wheels within the frame 24 and limiting axial movement of the print wheels yet permitting them to rotate freely about the axis 22.

As best seen in FIG. 2, the print wheel head 16 is positioned vertically above a connector housing 30 to be marked with identifying characters. The connector housing 30, which is part of an electrical cable assembly 32, is positioned within a track 34 which is part of an automated cable making machine that is not shown. Suitable mechanisms, not show, are provided to deliver the connector housing 30 to the appropriate position in the track 34 so that a desired set of characters can be imprinted thereon by the print wheel head 16, and under control of the automated cable making machine. A supply of hot stamping foil 36 is delivered to the vicinity of the print wheel head 16 in the usual manner from a reel 38. A take up reel 40 collects the used foil 36 for subsequent discarding.

Figure 3:
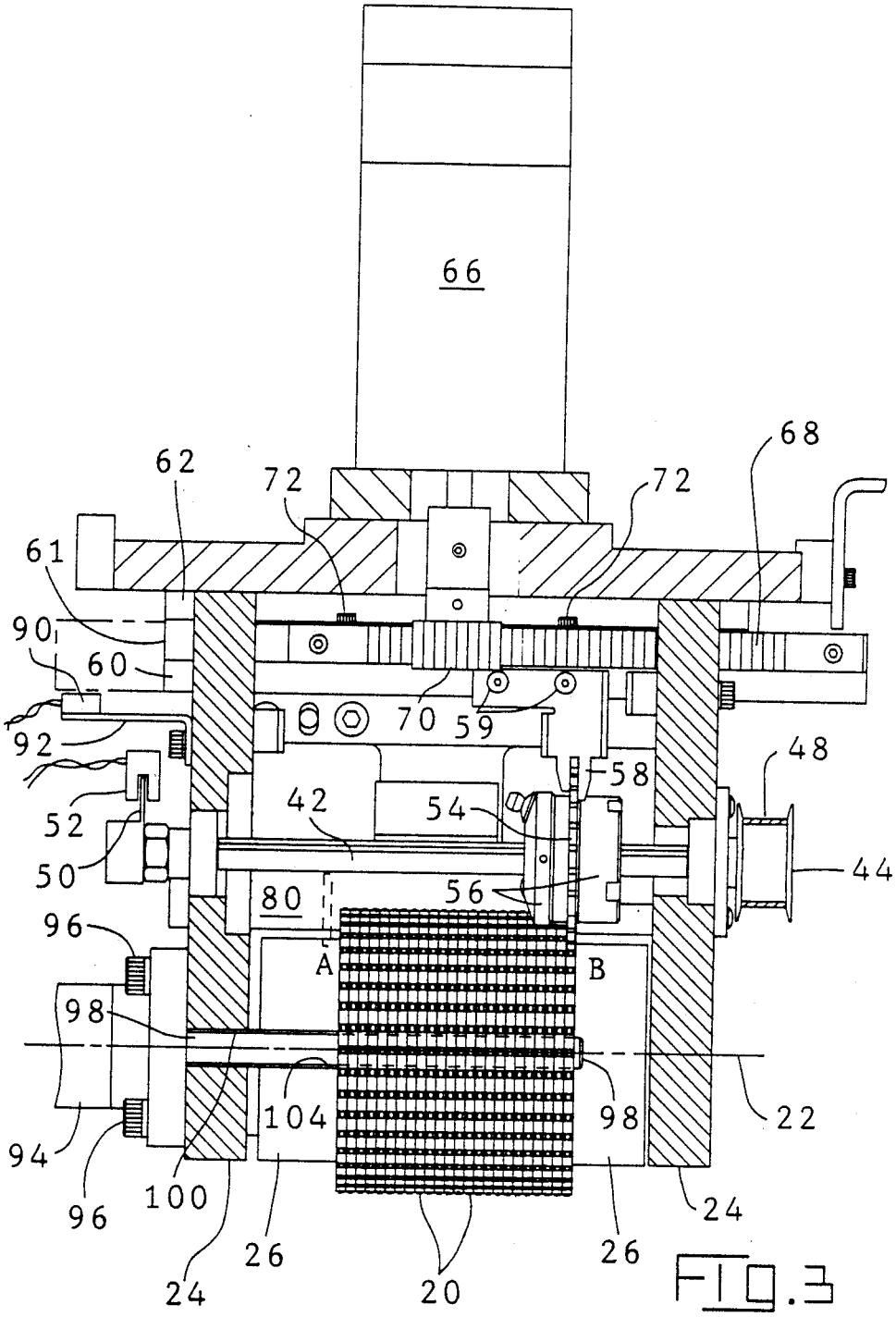
FIG. 3 is a top view of a portion of the apparatus of FIG. 1 taken along the lines 3—3.

A spline shaft 42, best seen in FIG. 3, is journaled for rotation within the frame 24, having its longitudinal axis parallel with the axis 22 of the print wheels 20. One end of the spline shaft 42 has attached thereto a pulley 44 which is drivingly coupled to a servo motor 46 by means of the belt 48. The other end of the spline shaft has a positioning vane 50 rigidly attached thereto so that the vane 50 will rotate with the shaft 42. A sensor 52, which may be a Hall-effect device or some other suitable sensor, is arranged to sense the position of the vane 50 and thereby very accurately determine the exact angular position of the shaft 42 in a manner that is well-known in the art. A sprocket 54 is slidingly coupled to the spline shaft 42 by means of the coupling 56 so that the sprocket must rotate with the spline shaft 42 but is free to move along the longitudinal axis of the shaft 42. A yolk 58 engages the sides of the sprocket 54 and is arranged to impart lateral movement to the sprocket along the axis of the shaft 42 without hindering the sprocket's ability to rotate along with the shaft 42. The yolk 58 is attached by means of the screw fasteners 59 to a movable portion 60 of a slide assembly having its stationary portion 62 attached to the frame 24, as best seen in FIG. 3. The slide is arranged so that the yolk 58 is carried in a direction parallel with the axis of the shaft 42. A servo motor 66 is drivingly coupled to the movable portion 60 of the slide by means of the rack 68 and pinion 70, the rack being attached to the movable portion 60 by means of the screw fasteners 72. The spline shaft 42 is spaced from the print wheels 20 so that the sprocket 54 meshes with the teeth 24 formed on the periphery of the print wheels. Thus, the servo motor 66 can drive the rack 68 and yolk 58 to position the sprocket 54 in meshing engagement with any selected one of the plurality of print wheels 20. The servo motor 46 can then rotate the sprocket 54 by means of the spline shaft 42, pulley 44, and belt 48, to accurately position the selected print wheel 20 so that a desired character is in printing position directly above the connector housing 30, as viewed in FIG. 2.

A locking bar 80 is rigidly attached to the movable portion 60 of the slide by means of the bracket 82 and screw fasteners 84. The locking bar 80 engages the space between two adjacent teeth 24 of each print wheel 20 to prevent rotation thereof. A clearance slot 86, disposed in the engaging portion of the locking bar 80, is in alignment with the sprocket 54, see FIG. 2. This clearance slot 86 is slightly wider than a single print wheel 20 and permits rotation of a selected print wheel when rotated by the sprocket 54 while all other print wheels 20 are prevented from rotating. The locking bar 80 is wide enough to span all of the plurality of print wheels 20 when the sprocket is in a park position indicated as either "A" or "B" on either the left or right side respectively of the print wheels, see FIG. 3. Note that when the sprocket 54 is in the park position "A", the end 61 of the movable portion 60 of the slide extends to the left as indicated by the phantom lines in FIG. 3. A proximity switch 90, which is attached to the frame 24 by means of the bracket 92, is positioned to close when it senses that the end 61 is in this position. The purpose of the switch 90 will be explained below.

A linear actuator, or air cylinder 94 is attached to the left side of the frame 24 by means of the screw fasteners 96, as shown in FIGS. 1 and 3. A piston rod 98 extends from the cylinder 94, through a clearance hole 100 in the frame 24, and into proximity with the leftmost print wheel 20. Each of the print wheels 20 has a hole 102 formed therethrough so that, when the print wheel is in a particular angular position called its "home position", the hole 102 is in alignment with the hole 100. Therefore, when all of the print wheels 20 are in their respective home positions, all of the holes 102 are in alignment with the hole 100 and the piston rod 98 may be inserted completely therethrough as shown in FIG. 3. In the present example, the leftmost spacer 26 has a clearance slot 104 disposed therein to provide adequate clearance for the piston rod 98 to freely pass. A pair of proximity sensors 106 and 108 are positioned at opposite ends of the air cylinder 94 as shown in FIG. 1. The sensors 106,108 are arranged to detect the presence of the piston within the cylinder so that when the piston rod 98 has extended fully through all of the print wheels 20, as shown in FIG. 3, the sensor 108 is actuated. When the piston rod 98 is fully retracted, as shown in FIG. 1, the sensor 106 is actuated.

The operation of the invention will now be described with particular reference to FIG. 6. Control of the operation of the automated cable making machine is usually accomplished by means of a computer such as, in the present case, an STD bus utilizing an Intel 8088 microprocessor or the like. Such a computer, designated as reference number 120 in FIG. 6, is also utilized to control the operation of the print wheel setting apparatus of the present invention. Appropriately coded instructions will be resident in the computer 120 to carry out the following described method of operation.

Assume that the automated cable making machine has just begun operating and a first connector housing 30 is in position in the track 34 waiting to be marked with a particular set of characters. The computer 20 will determine that the actual positions of the plurality of print wheels 20 are unknown since this is the first connector housing to be imprinted. Therefore, the computer 120 will initiate a homing procedure whereby each print wheel will be set to a known position. After this is done, each print wheel will then be set in accordance with the desired set of characters which are retained within the computer's memory.

The method of the present invention to first set all of the plurality of print wheels 20 to their respective home positions and then to set them to their respective desired character positions is as follows.

The computer 120 signals the servo 46 to rotate the spline shaft 42 until the vane 50 is sensed by the sensor 52. The shaft 42 is then rotated a slight amount in the opposite direction and then again rotated in the original direction, but at a slower rate, until the vane 50 is again sensed by the sensor 52. This assures that the angular position of the shaft 42 and therefore the position of the sprocket 54 is very precisely set so that when the sprocket 54 is subsequently moved laterally, it will mesh with the teeth 74 of the adjacent print wheel. When attempting to align the vane 50 with the sensor 52, should the sprocket 54 be positioned between two adjacent print wheels, both print wheels will be locked by the locking bar 80 thereby preventing rotation of the sprocket 54. This is interpreted by the computer 120 to indicate that the sprocket teeth are already in mesh with the teeth 74 of the adjacent print wheels. The computer 120 then signals the servo 66 to move the sprocket 54 laterally to its park position "A", which is indicated by the computer 120 receiving an appropriate signal from the sensor 90. The computer !20 will then signal the servo 66 to move the sprocket 54 first away from the park position a slight amount and then back toward the park position, but at a slower rate, until the appropriate signal is again received from the sensor 90. This will assure that the sprocket 54 is very precisely positioned in its park position "A". The computer 120 then signals the servo 66 to move the sprocket 54 from its known park position to the first print wheel 20 which is now considered the selected print wheel. The computer 120 activates the linear actuator or, in the present case the air cylinder 94 by signaling it to pressurize and extend the piston rod 98 until it encounters the side of a print wheel 20, then to deactivate by releasing the pressure but leaving the piston rod 98 in its present extended position. The computer 230 will then check the output of the sensor 108. If the sensor 108 is sensing the piston of the cylinder 94, then the piston rod 98 has passed completely through all of the print wheels 20 thereby indicating that the wheels are in their respective home positions. In the present example this is not the case, therefore, the computer 120 proceeds to setting the print wheels 20 to their respective desired characters as will be described below.

Figure 4:
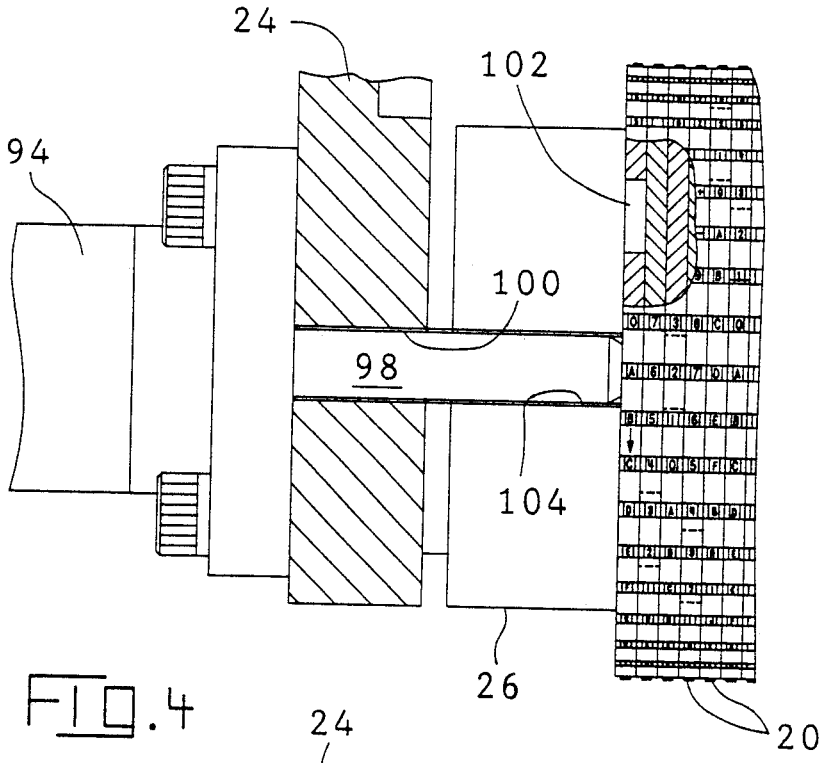
FIGS. 4 and 5 are enlarged views of a portion of the mechanism shown in FIG. 3.
Figure 5:
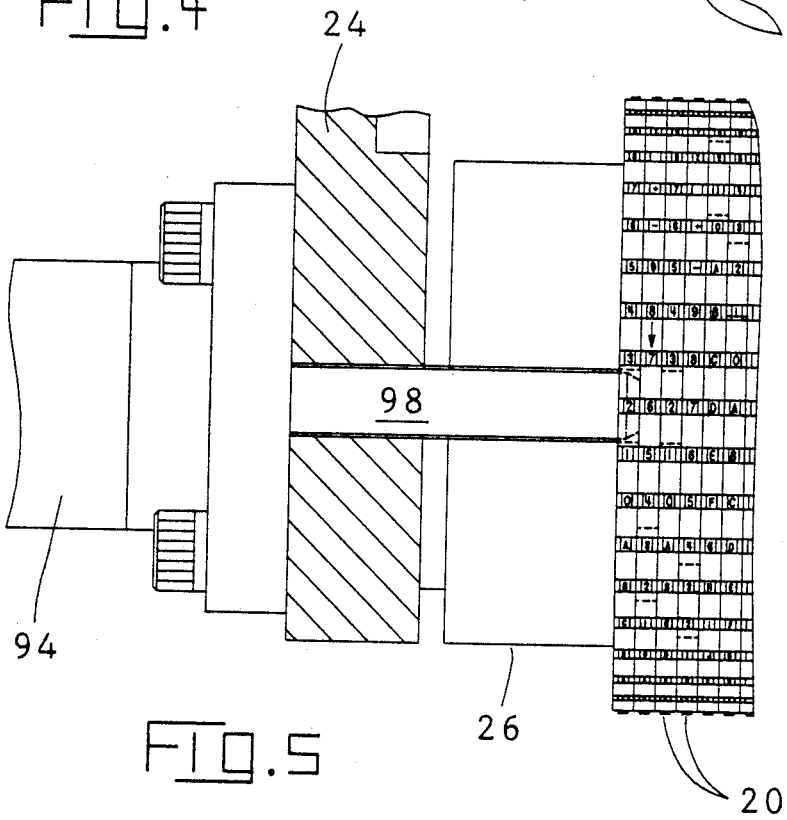
Figure 5:
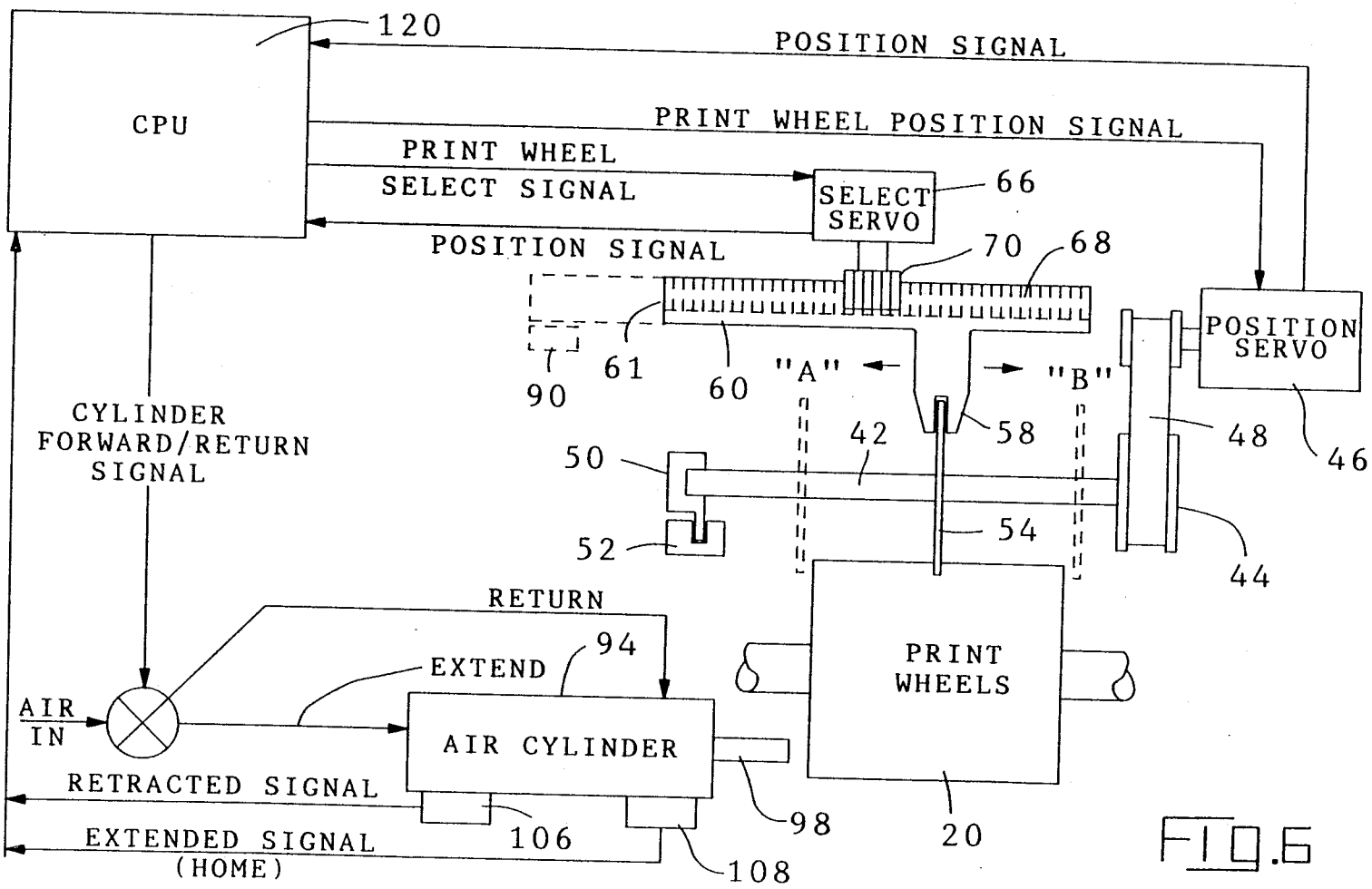

When all of the print wheels 20 are not in their home positions the computer 120 signals the servo 46 to rotate the selected print wheel 20 to its next incremental position. The computer 120 then determines if the selected print wheel wheel 20 has actually rotated to the next position by comparing the position signal received from the servo 46 to the position signal issued by the computer 120. If the selected print wheel did move to its next position, then the air cylinder 94 is again pressurized to extend the piston rod 98 until it engages the side of a print wheel 20 and then the pressure released. The computer 120 again signals the servo 46 to rotate the selected print wheel an incremental amount and then determines whether or not it actually moved to the next position. The state of the piston rod 98 and the first print wheel 20, at this point, is as shown in FIG. 4. This process continues until the hole 102 in the selected print wheel 20 is rotated into alignment with the hole 100. Then, when the air cylinder 94 is again pressurized, the piston rod 98 enters the hole 102, as seen in FIG. 5, and comes to rest against the wall of the second print wheel 20. The piston rod 98 entering the hole 102 positively stops the selected print wheel from further rotation. Therefore, a subsequent try to rotate the selected print wheel 20 to the next position will fail and the computer 120 will assume that the selected print wheel is in its home position and will move on to the next print wheel. This process is repeated until all of the plurality of print wheels 20 are in their respective home positions with their respective holes 102 in alignment and the piston rod 98 extending therethrough as shown in FIG. 3.

At this point, all of the print wheels are in a known position and can easily be rotated to a desired position by simply stepping each print wheel through a given number of incremental positions to reach its desired character position. This is accomplished in the present example by pressurizing the return side of the air cylinder 94 to fully retract the piston rod 98 to the position shown in FIG. 1. With the sprocket 54 still in engagement with the right-most print wheel 20, the computer 120 signals the servo 40 to rotate the wheel 20 the correct numbered incremental positions until it reaches the desired character position. The computer 120 then determines whether or not all of the print wheels 20 are set by means of the sensor 90 which indicates whether or not the sprocket 54 is in its park position "A". If all print wheels are not in their desired positions, the computer 120 again signals the servo 66 to move the sprocket 54 to select the next adjacent print wheel 20 and the process is repeated until all of the print wheels 20 are set to their desired positions and the sprocket is in its park position "A". The locking bar 80 will now be in locking engagement with all of the print wheels, as described above, and the print head 16 is now ready to imprint the desired series of characters onto the connector housing 30.

It will be understood by those skilled in the art that the above described steps of homing the print wheels 20 need be done prior to setting the print wheels to their desired positions only when their present respective positions are unknown. This will be the case, for example, when the computer 120 and the automated cable making machine are powered up to begin operation after a period of disuse, or after a power failure. Once the actual present position of each print wheel 20 is known, the computer 120 can easily determine the correct number of incremental positions through which to step each wheel 20 to reach its desired position.

One of the important advantages of the present invention is the capability of the hot stamping apparatus 10 to easily position each print wheel 20 in a known home position and then to accurately rotate the wheel 20 to a desired character position.

We claim:

1. In an article marking apparatus, a method of setting a plurality of print wheels of a print head to a desired value, wherein said apparatus includes a print head having a plurality of print wheels arranged for individual rotation, means for selecting individual ones of said plurality of print wheels and means for rotating each said selected wheel, wherein each of said print wheels has a home position relative to said apparatus, means for positively stopping rotation of each said print wheel when said print wheel reaches its home position only when said means is enabled, said method comprising the steps of:

(a) selecting the first of said plurality of print wheels;
(b) enabling said means for positively stopping rotation of said selected print wheel;
(c) if all print wheels are in their home positions, going to step (g);
(d) activating said means for rotating to rotate only the selected print wheel a specific amount;
(e) if said selected print wheel rotated said specific amount then repeating steps (b) through (e);
(f) selecting the next print wheel and repeating steps (b) through (f);
(g) disabling said means for positively stopping rotation; and
(h) setting said plurality of print wheels to their respective desired positions and locking them in place.

2. The method in accordance with claim 1 wherein said means for positively stopping rotation of each said print wheel includes a hole through each said wheel arranged so that when two or more of said wheels are in their respective home positions their respective holes are in mutual alignment along a first axis, and further includes a rod having a longitudinal axis substantially coincident with said first axis and sized to loosely pass into and through said holes of said two or more wheels and constrained to move only along its said axis, wherein step (b) includes inserting said rod into said hole of said selected print wheel upon said wheel reaching its home position.

3. The method in accordance with claim 2 wherein step (b) includes urging said rod in a direction along said first axis so that said rod is urged against said selected print wheel, whereby when said selected wheel is in its home position, said rod enters said hole and stops said rotation.

4. The method in accordance with claim 3 wherein said means for positively stopping rotation includes a linear actuator arranged to move said rod along its said longitudinal axis and step (b) includes activating and then deactivating said linear actuator.

5. In an article marking apparatus comprising a plurality of print wheels journaled for rotation and means for rotating selected ones of said print wheels to a desired print position, each of said print wheels having a home position relative to said machine, setting means for setting some of said plurality of print wheels to desired positions comprising;

(a) means for selecting one of said plurality of print wheels;

(b) means for incrementally rotating only said selected print wheel;

(c) means for positively stopping rotation of said selected print wheel only upon reaching its said home position;

(d) means for sensing that a selected print wheel has positively stopped; and (e) means for setting said selected print wheel to a desired character position from said wheel's home position, wherein said means for setting is operative only when said means for sensing has sensed that all of said plurality of print wheels have positively stopped.

6. The article marking apparatus according to claim 5 wherein said means for positively stopping rotation includes a hole through each said print wheel arranged so that when any of said wheels are only in their respective home positions their respective holes are in mutual alignment along a first axis, and further includes a rod having a longitudinal axis substantially coincident with said first axis and sized to loosely pass into and through said holes in said print wheels.

7. The article marking apparatus according to claim 6 wherein said means for positively stopping rotation includes a linear actuator arranged to move said rod along its said longitudinal axis.

8. A print head for marking an article comprising a plurality of print wheels arranged for individual rotation each of which has a home position; means for selecting individual ones of said plurality of print wheels; means for rotating only said selected print wheel; stopping means for positively stopping rotation of said selected print wheel only upon said print wheel being in its said home position only when said stopping means is enabled; means for sensing that a selected print wheel has positively stopped; and means for setting said selected print wheel to a desired character position from said wheel's home position.

9. The print head according to claim 8 wherein said means for positively stopping rotation includes a hole through each said print wheel arranged so that when any of said wheels are only in their respective home positions their respective holes are in mutual alignment along a first axis, and further includes a rod having a longitudinal axis substantially coincident with said first axis and sized to loosely pass into and through said holes in said print wheels.

10. The print head according to claim 9 wherein said means for positively stopping rotation includes a linear actuator arranged to move said rod along its said longitudinal axis.

* * * * *